US009462860B1

(12) United States Patent
Whetstone, Jr.

(10) Patent No.: US 9,462,860 B1
(45) Date of Patent: Oct. 11, 2016

(54) UMBRELLA WITH AN EXTENDABLE COVER

(71) Applicant: Timmy Whetstone, Jr., Birmingham, AL (US)

(72) Inventor: Timmy Whetstone, Jr., Birmingham, AL (US)

( * ) Notice: Subject to any disclaimer, the term of this patent is extended or adjusted under 35 U.S.C. 154(b) by 0 days.

(21) Appl. No.: 14/831,680

(22) Filed: Aug. 20, 2015

(51) Int. Cl.
*A45B 25/18* (2006.01)

(52) U.S. Cl.
CPC ..... *A45B 25/18* (2013.01); *A45B 2025/186* (2013.01)

(58) Field of Classification Search
CPC ..... A45B 25/18; A45B 2025/183; A45B 2025/186; A41D 15/04
USPC ..... 135/16, 33.2, 33.71
See application file for complete search history.

(56) References Cited

U.S. PATENT DOCUMENTS 373,378 A * 11/1887 Rumrille ..... E04H 15/28 135/114
719,899 A * 2/1903 Stacy ..... A41D 15/04 135/95
734,311 A * 7/1903 Ferroussat ..... A45B 3/00 135/16
2,221,366 A * 11/1940 Bisbing ..... E04H 15/28 135/117
2,319,983 A * 5/1943 Furman ..... A41D 1/16 135/16
2,412,415 A * 12/1946 Navon ..... A41D 3/08 135/16
2,502,984 A * 4/1950 Parmenter ..... A45B 25/18 135/16
2,546,228 A 3/1951 Martini
3,151,621 A * 10/1964 Jackson ..... A45B 23/00 135/16
4,022,233 A * 5/1977 Grundman ..... A45B 15/00 135/20.1
5,464,034 A * 11/1995 Kestin ..... A45B 11/04 135/20.2
5,664,595 A * 9/1997 Vonderhorst ..... A45F 3/52 135/15.1
5,740,822 A * 4/1998 Einck ..... A45B 23/00 135/16
7,434,591 B2 * 10/2008 Church ..... A45B 23/00 135/16
7,581,555 B2 * 9/2009 McCullough ..... A45B 23/00 135/16
8,042,561 B2 10/2011 Moravec Varga et al.
2005/0028851 A1 * 2/2005 Knoepp ..... A45B 25/20 135/15.1
2010/0139726 A1 * 6/2010 Everett, Sr. ..... A45B 25/18 135/33.71
2011/0240073 A1 * 10/2011 Reid ..... A45B 11/00 135/16

* cited by examiner

*Primary Examiner* — Noah Chandler Hawk
(74) *Attorney, Agent, or Firm* — Crossley & Stevenson Intellectual Property Law

(57) ABSTRACT

An umbrella with an extendable cover including an umbrella having a shaft, a handle, and a canopy, a bell-shaped cover continuously attached to a perimeter of an underside of the canopy proximal an outer edge of the canopy, a sleeve attached to the cover, a glove attached to the sleeve, a pair of controls disposed on the shaft proximal the handle, and a lever slidably engaged with a vertical slot disposed through the shaft proximal the handle. The cover has an extended position and an alternate retracted position. The cover is in the extended position when a bottom edge of the cover is vertically disposed at a maximum distance away from a top edge of the cover. The cover is in the retracted position when the bottom edge of the cover is disposed proximal the top edge of the cover within the underside of the canopy.

4 Claims, 3 Drawing Sheets

UMBRELLA WITH AN EXTENDABLE COVER

BACKGROUND OF THE INVENTION

Various types of umbrellas are known in the prior art. However, what has been needed is an umbrella with an extendable cover including an umbrella having a shaft, a handle, and a canopy, a bell-shaped cover continuously attached to a perimeter of an underside of the canopy proximal an outer edge of the canopy, a sleeve attached to the cover, a glove attached to the sleeve, a pair of controls disposed on the shaft proximal the handle, and a lever slidably engaging a vertical slot disposed through the shaft proximal the handle. What has been further needed is for the cover to have an extended position and an alternate retracted position. The cover is in the extended position when a bottom edge of the cover is vertically disposed at a maximum distance away from a top edge of the cover. The cover is in the retracted position when the bottom edge of the cover is disposed proximal the top edge of the cover within the underside of the canopy.

The umbrella with an extendable cover provides a user with full body protection against the rain, while also protecting the user's electronics and other goods that are being carried on or close to the user's person. The sleeve and glove attached to the cover provides the user with further protection against the elements by allowing the user to unlock a car or house door without getting wet. Furthermore, the umbrella with an extendable cover can be produced in varying shapes and sizes and with varying colors and designs.

FIELD OF THE INVENTION

The present invention relates to umbrellas, and more particularly, to an umbrella with an extendable cover.

SUMMARY OF THE INVENTION

The general purpose of the present umbrella with an extendable cover, described subsequently in greater detail, is to provide an umbrella which has many novel features that result in an umbrella with an extendable cover which is not anticipated, rendered obvious, suggested, or even implied by prior art, either alone or in combination thereof.

To accomplish this, the present umbrella with an extendable cover includes an umbrella, a bell-shaped cover, a sleeve, a glove, a pair of controls, and a lever. The umbrella has a shaft, a handle attached to a bottom end of the shaft, and a canopy. The canopy has an underside and an outer edge. The canopy is attached to a top end of the shaft. The canopy has an open position and an alternate closed position. The cover has a top edge and a weighted bottom edge. The top edge of the cover is continuously attached to a perimeter of the underside of the canopy proximal the outer edge. A length of the cover is substantially double a length of the shaft. The cover is optionally transparent. The cover is also optionally polyvinyl chloride, and alternately, nylon. The cover has an extended position and an alternate retracted position. The cover is in the extended position when the bottom edge of the cover is vertically disposed at a maximum distance away from the top edge of the cover. The cover is in the retracted position when the bottom edge of the cover is disposed proximal the top edge of the cover within the underside of the canopy.

The sleeve has a top side and a bottom side. The top side of the sleeve is substantially medially attached to the cover. The glove is attached to the bottom side of the sleeve. The sleeve is configured to allow a user to slide an arm into the sleeve and a hand into the glove in order to protect the user's hand and arm from the rain. The sleeve can be pulled back into the underside of the canopy when not in use.

The pair of controls includes an activation control and a deactivation control. Each of the activation control and the deactivation control is disposed on the shaft proximal the handle. The activation control is configured to move the canopy to the open position. The deactivation control is configured to move the canopy to the closed position. The lever slidably engages a vertical slot. The vertical slot is disposed through the shaft proximal the handle. The lever has an up position and an alternate down position. The lever is configured to move the cover to the extended position when the lever is in the up position. The lever is configured to move the cover to the retracted position when the lever is in the down position.

Thus has been broadly outlined the more important features of the present umbrella with an extendable cover so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 5 thereof, an example of the instant umbrella with an extendable cover employing the principles and concepts of the present umbrella with an extendable cover and generally designated by the reference number 10 will be described.

Figure 1:
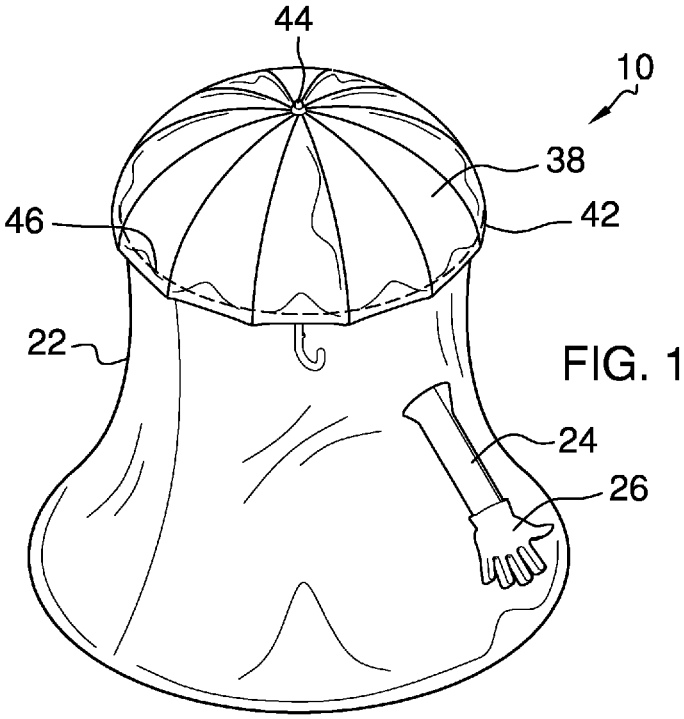
FIG. 1 is a front isometric view.
Figure 2:
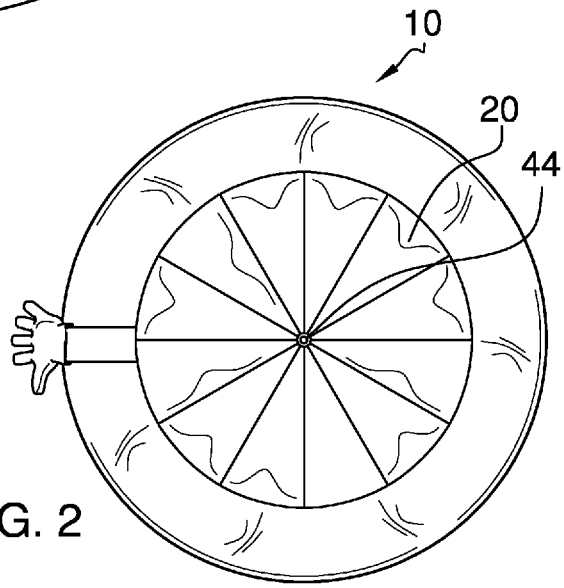
FIG. 2 is a top plan view.
Figure 3:
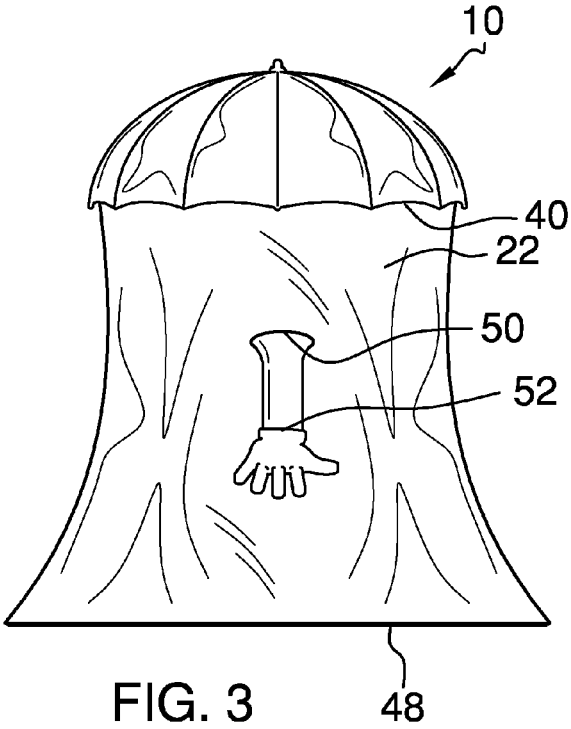
FIG. 3 is a side elevation view.
Figure 4:
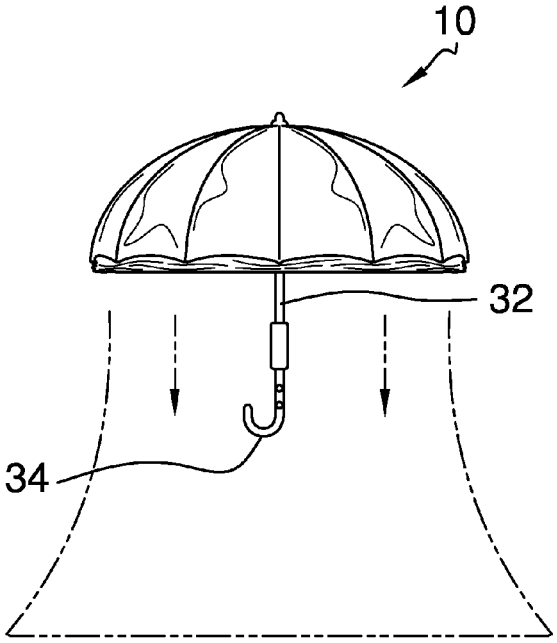
FIG. 4 is a rear elevation view showing a cover in a retracted position.
Figure 5:
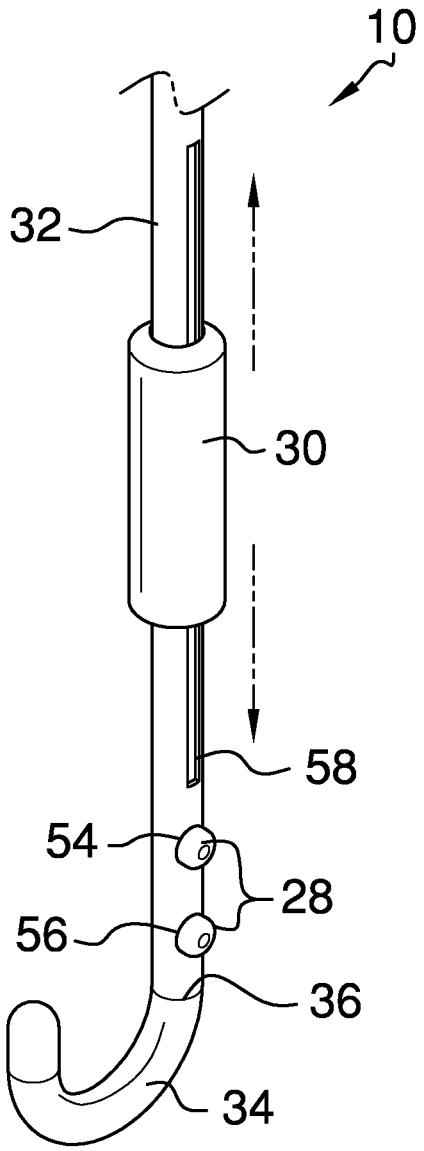
FIG. 5 is detail view showing a pair of controls and a lever.

Referring to FIGS. 1 through 5 the present umbrella with an extendable cover 10 is illustrated. The umbrella with an extendable cover 10 includes an umbrella 20, a bell-shaped cover 22, a sleeve 24, a glove 26, a pair of controls 28, and a lever 30. The umbrella 20 has a shaft 32, a handle 34 attached to a bottom end 36 of the shaft 32, and a canopy 38. The canopy 38 has an underside 40 and an outer edge 42. The canopy 38 is attached to a top end 44 of the shaft 32. The cover 22 has a top edge 46 and a weighted bottom edge 48. The top edge 46 of the cover 22 is continuously attached to a perimeter of the underside 40 of the canopy 38 proximal the outer edge 42. The cover 22 has an extended position and an alternate retracted position. As best shown in FIG. 1, the cover 22 is in the extended position when the bottom edge 48 of the cover 22 is vertically disposed at a maximum distance away from the top edge 46 of the cover 22. As best shown in FIG. 4, the cover 22 is in the retracted position when the bottom edge 48 of the cover 22 is disposed proximal the top edge 46 of the cover 22 within the underside of the canopy 38.

The sleeve 24 has a top side 50 and a bottom side 52. The top side 50 of the sleeve 24 is substantially medially attached to the cover 22. The glove 26 is attached to the bottom side 52 of the sleeve 24.

The pair of controls 28 includes an activation control 54 and a deactivation control 56. Each of the activation control 54 and the deactivation control 56 is disposed on the shaft 32 proximal the handle 34. The lever 30 slidably engages a vertical slot 58. The vertical slot 58 is disposed through the shaft 32 proximal the handle 34.

What is claimed is:

1. An umbrella with an extendable cover comprising:

an umbrella having a shaft, a handle attached to a bottom end of the shaft, and a canopy having an underside and an outer edge, the canopy attached to a top end of the shaft;

wherein the canopy has an open position and an alternate closed position;

a bell-shaped cover having a top edge and a weighted bottom edge, the cover top edge continuously attached to a perimeter of the canopy underside proximal the outer edge;

wherein a length of the cover is substantially double a length of the shaft;

wherein the cover has an extended position and an alternate retracted position;

wherein the cover is in the extended position when the cover bottom edge is vertically disposed at a maximum distance away from the cover top edge;

wherein the cover is in the retracted position when the cover bottom edge is disposed proximal the cover top edge within the canopy underside;

a sleeve having a top side and a bottom side, the sleeve top side substantially medially attached to the cover;

a glove attached to the sleeve bottom side;

wherein the sleeve is configured to allow a user to slide an arm into the sleeve and a hand into the glove in order to protect the user's hand and arm from the rain;

a pair of controls comprising an activation control and a deactivation control, each of the activation control and the deactivation control disposed on the shaft proximal the handle;

wherein the activation control is configured to move the canopy to the open position;

wherein the deactivation control is configured to move the canopy to the closed position;

a lever slidably engaged with a vertical slot disposed through the shaft proximal the handle;

wherein the lever has an up position and an alternate down position;

wherein the lever is configured to move the cover to the extended position when the lever is in the up position;

wherein the lever is configured to move the cover to the retracted position when the lever is in the down position.

2. The umbrella with an extendable cover of claim 1 wherein the cover is transparent.

3. The umbrella with an extendable cover of claim 2 wherein the cover is polyvinyl chloride.

4. The umbrella with an extendable cover of claim 2 wherein the cover is nylon.

* * * * *